US005370138A

United States Patent [19]

Mou

[11] Patent Number: 5,370,138

[45] Date of Patent: Dec. 6, 1994

[54] DISPOSABLE PAPER ASHTRAY

[76] Inventor: Pai-Her Mou, 9F3R, No. 210, Chung Hsueh Rd., Tainan, Taiwan, Prov. of China

[21] Appl. No.: 109,348

[22] Filed: Aug. 10, 1993

[51] Int. Cl.[5] ..... A24F 19/02; A24F 19/14

[52] U.S. Cl. ..... 131/236; 131/231; 206/496; 220/405; 220/62

[58] Field of Search ..... 206/496; 220/405, 512, 220/62; 131/231, 240.1, 241, 242, 242.6, 236

[56] References Cited

U.S. PATENT DOCUMENTS

| | | | |
|---|---|---|---|
| 1,614,265 | 1/1927 | Stockton | 131/240.1 |
| 1,763,678 | 6/1930 | Smith | 131/236 |
| 1,959,134 | 5/1934 | Martin | 131/231 X |
| 2,167,261 | 7/1939 | Sadtler | 131/231 |
| 3,372,724 | 3/1968 | Rouse | 131/231 X |
| 3,401,702 | 9/1968 | Rossman | 131/240.1 X |
| 3,404,693 | 10/1968 | Chapman | 131/242.6 X |
| 4,060,092 | 11/1977 | Pappas | 131/236 |
| 4,328,895 | 5/1982 | Jaeger | 131/231 X |
| 4,580,581 | 4/1986 | Reece et al. | 131/231 |
| 4,726,472 | 2/1988 | Su | 220/405 X |
| 4,896,825 | 1/1990 | Moeller | 131/241 X |
| 5,038,801 | 8/1991 | Wang | 131/231 X |

FOREIGN PATENT DOCUMENTS

| | | | |
|---|---|---|---|
| 2566240 | 12/1968 | France | 131/240.1 |
| 2626442 | 8/1989 | France | 131/231 |
| 2254537 | 10/1992 | United Kingdom | 131/236 |

*Primary Examiner*—Jennifer Bahr

[57] ABSTRACT

A disposable paper ashtray formed by folding a flat sheet of recycled paper made by compress process, having four side walls, a bottom and an upper holed flat portion extending from one of two opposite sides and folded to cover on an upper side and a separate bottom paper placed on an inner surface of the bottom and wetted with water for extinguishing burning or smoking cigarette butts.

4 Claims, 5 Drawing Sheets

DISPOSABLE PAPER ASHTRAY

BACKGROUND OF THE INVENTION

Many kinds of ashtrays are in use nowadays for smokers to tap ashes off cigarettes and throw butts of cigarettes therein, generally made of glass, china or plastics, which are always cleaned for repeated use. But they are easily broken by dropping on the ground by accident or carelessness. Plastic ones can endure, uneasily to break, but on the other hand, they are not biodegradable, to pollute the environment when discarded.

Ashtrays made of paper widely seen among those on market or disclosed in various patents previously acquired, but they mostly have no function of extinguished fires of still burning cigarette butts placed therein. Consequently, paper ashtrays are not so much in use, because they involve public harm caused by second-hand smoking and risk of fires.

SUMMARY OF THE INVENTION

This invention has been devised to offer a kind of disposable paper ashtray, which cannot pollute our environment in case it is discarded, and cost very cheap to be discarded.

The disposable paper ashtray in the present invention has a feature that its body including four side walls and a bottom has the inner surfaces coated with thin layer of wax, an upper holed flat portion covering on an upper side having many holes for cigarette butts to insert through to touch a wetted bottom paper laid on an inner surface of the bottom.

Another feature is that the upper holed flat portion prevents vents the ash tapped dean on the wetted bottom paper from falling or flying out of the ashtray.

Another feature is that the wetted bottom paper can be toilet paper wetted with water, instead of cotton or sponge, reducing cost quite a little.

One more feature is that the upper holed flat portion can be also over laid on the bottom paper, having the same function as the one separated with each other with a little distance.

DETAILED DESCRIPTION OF THE INVENTION

Figure 1:
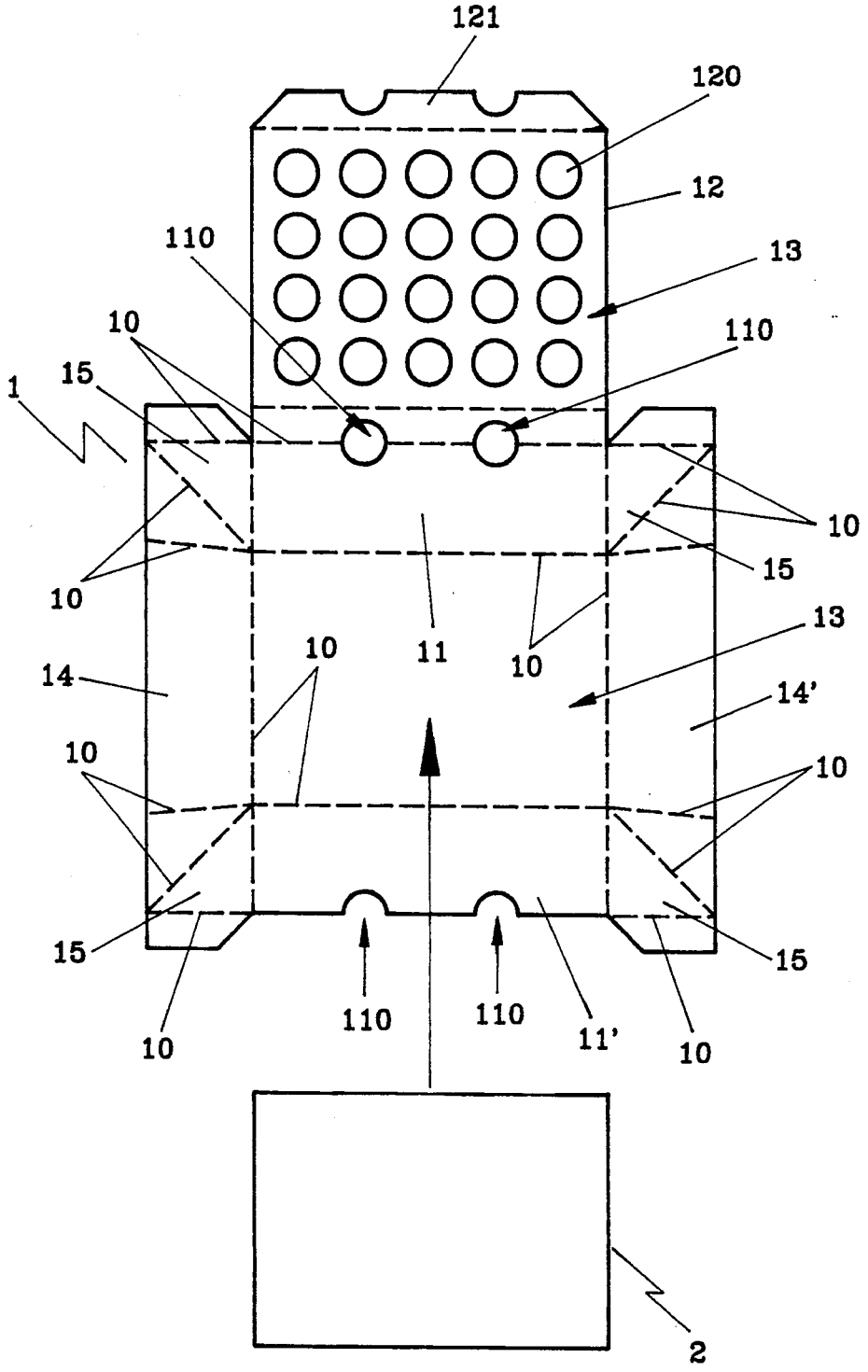
FIG. 1 is a unfolded elevational flat view of a first embodiment of a disposable paper ashtray in the present invention.
Figure 2:
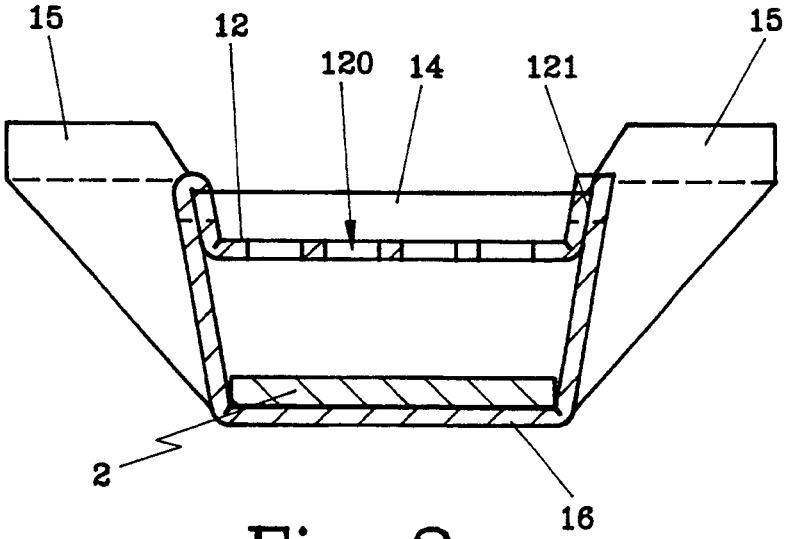
FIG. 2 is a cross-sectional view of the first embodiment of the disposable paper ashtray in the present invention.
Figure 3:
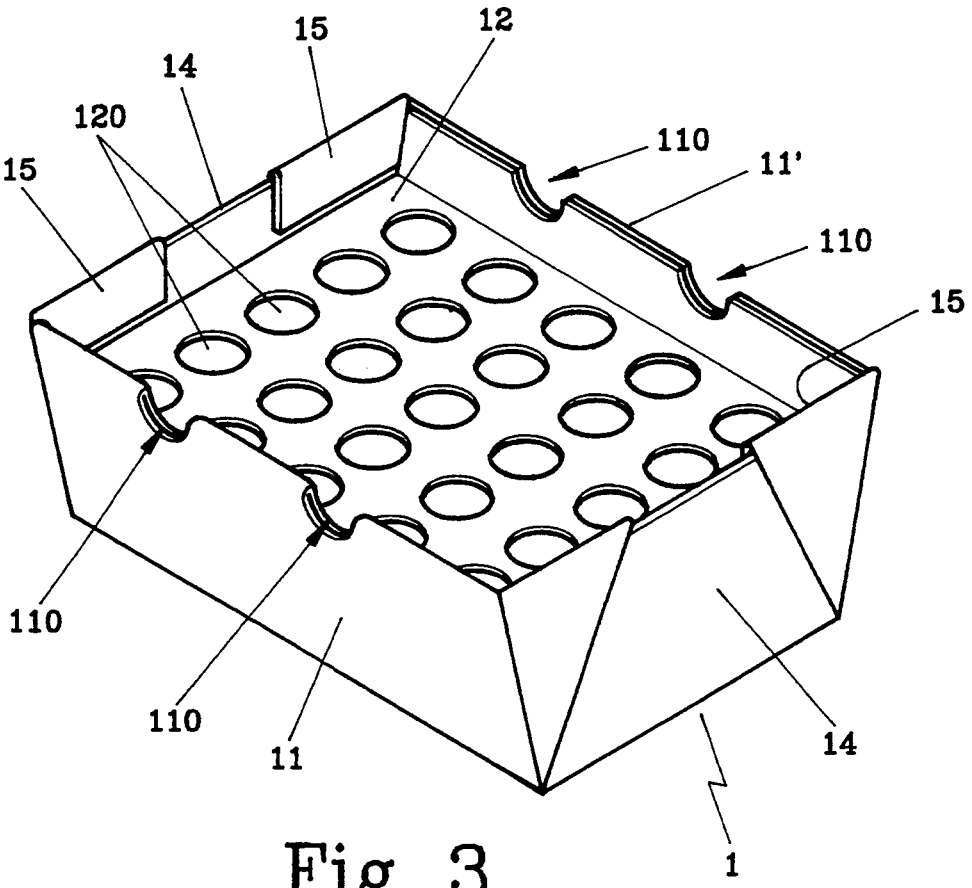
FIG. 3 is a perspective view of the first embodiment of the disposable paper ashtray in the present invention.

A disposable paper ashtray in the present invention, as shown in FIGS. 1, 2 and 3, is formed by folding a flat paper body 1 made of recycled paper made by press process, and the paper body 1 has a plurality of folding lines 10 so as to be folded along those lines to make up four side walls 11, 11', 14, 14' and a bottom 13, and an upper holed flat portion 12 extends outward from one of two opposite side walls 11, 11'. An inner surface of the bottom 13 of the paper body 1 is coated with a thin layer of water-proof wax, preventing water from percolating into the paper body 1. Several spaced notches 110 are provided in outer edges of the side walls 11, 11' for receiving cigarette thereon.

The upper holed flat portion 12 has a plurality of little holes 120 orderly or disorderly arranged for cigarette butts to be inserted through and for yet the burning or smoking tip of a cigarette butt can touch a wetted bottom paper 2 and be extinguished. A folded side 121 of the upper holed flat portion 12 is adhered with the side wall 11' of the paper body 1 with adhesive as shown in FIGS. 2 and 3.

A wetted bottom paper 2 may be toilet paper folded to suit to the size of an inner bottom of this ashtray, and a little water is to be poured on the bottom paper 2 after it is placed therein to easily extinguish yet burning or smoking cigarette butts.

The other two opposite sides 14, 14' have four corner fold portions 15 at both ends, which are folded inward the two opposite sides 14, 14' as shown in FIG. 3, completing folding this ashtray. Adhering the two opposite sides 14. 14' is dependent on personal selection. Makers can sell to consumers this disposable paper ashtray with only the upper holes portion 12 adhered and the wetted bottom paper 2 put therein, reducing its cost and dimensions for transportation.

Figure 4:
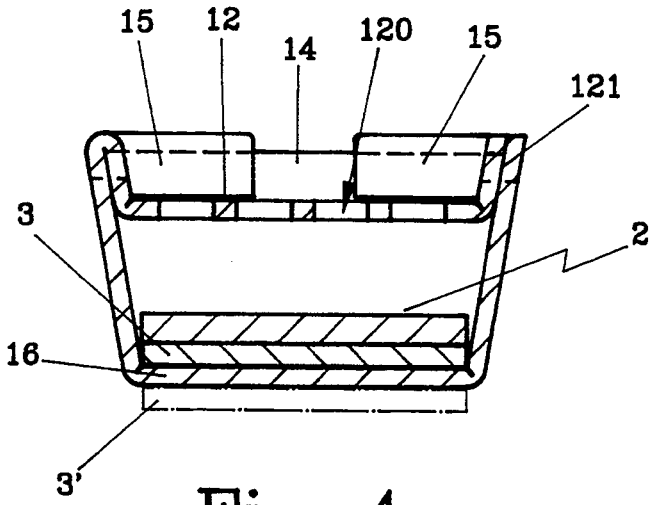
FIG. 4 is a cross-sectional view of a second embodiment of the disposable paper ashtray in the present invention.

A second embodiment of the disposable paper ashtray is shown in FIG. 4, having almost the same structure as the first embodiment shown in FIGS. 1, 2 and 3, except an extra bottom paper 3 placed under the bottom paper 2 and another extra bottom paper 3' under the bottom of the paper body 1 to increase stability of this ashtray.

Figure 5:
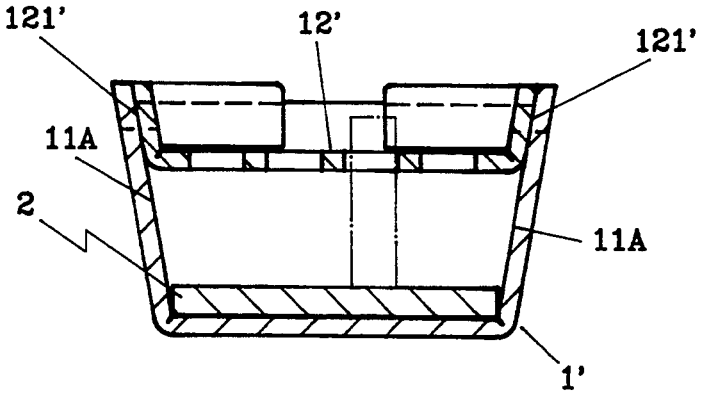
FIG. 5 is a cross-sectional view of a third embodiment of the disposable paper ashtray in the present invention.

A third embodiment of the disposable paper ashtray shown in FIG. 5 has a separate upper holed flat portion 12', not the same as the first embodiment, and the separate upper holed flat portion 12' has two opposite sides 121', 121' adhered on inner side walls 11A.

Figure 6:
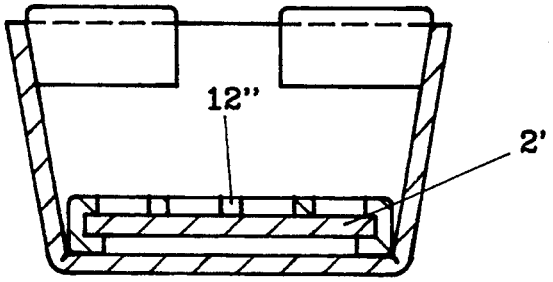
FIG. 6 is a cross-sectional view of a fourth embodiment of the disposable paper ashtray in the present invention.

A fourth embodiment of the disposable paper ashtray as shown in FIG. 6 has an upper holed flat portion 12' lowered down to overlie on a bottom paper 12'' for extinguishing burning or smoking cigarette butts.

Figure 7:
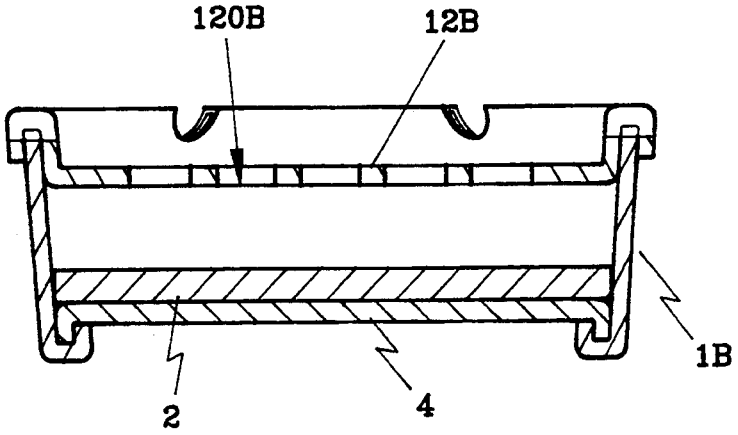
FIG. 7 is a cross-sectional view of a fifth embodiment of the disposable paper ashtray in the present invention.
Figure 8:
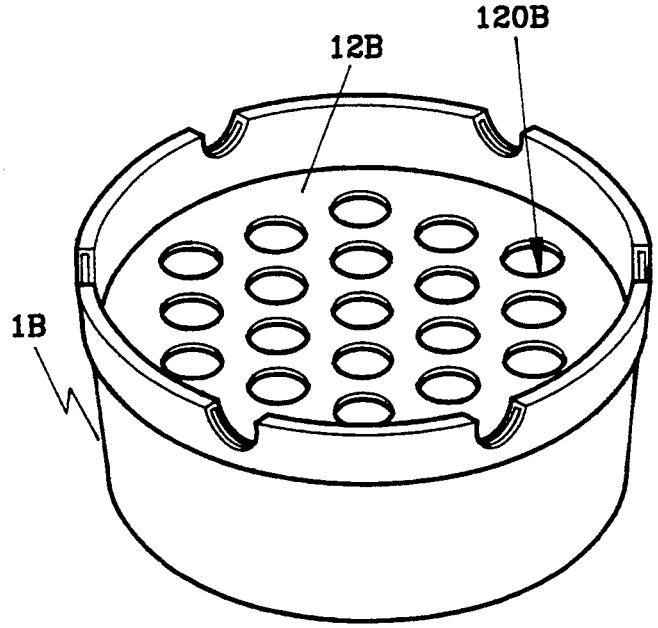
FIG. 8 is a perspective view of the fifth embodiment of the disposable paper ashtray in the present invention.

A fifth embodiment of the disposable paper ashtray shown in FIGS. 7 and 8 has an annular side wall 1B and a separate round bottom 4 adhered with a lower end portion of the annular side wall 1B. a bottom paper 2 put on the bottom 4 and an upper holed flat portion 12B having a bending annular flange, a plurality of holes 120B and capping on the annular side wall 1B.

A space provided between the wetted bottom paper 2 and the upper holed flat portion 12 functions extremely ideally to prevent cigarette ashes accumulated on the wetted bottom paper from falling or flying out of the ashtray.

What is claimed is:

1. A disposable paper ashtray comprising:

a flat paper body having four sides connected with four folded lines with a bottom, each neighboring two of said four sides having a corner portion connected with folded lines, an upper holed flat portion having a plurality of little holes and extending from one of said four sides;

a separate bottom paper placed on an upper surface of said bottom; and a hollow space formed between said upper holed flat portion and said separate bottom paper, said separate bottom paper being wetted with water to extinguish burning or smoking cigarette butts.

2. The disposable paper ashtray claimed in claim 1, wherein an extra sheet of paper is added between said bottom paper and said bottom of the body and another extra one also under said bottom of the flat paper body.

3. The disposable paper ashtray claimed in claim 1, where in said flat paper body is adhered with a separate bottom.

4. A disposable paper ashtray comprising:

a flat paper body having four sides connected with four folded lines with a bottom, each neighboring two of said four sides having a corner portion connected with folded lines, an upper holed flat portion having a plurality of little holes and two opposite sides glued with the inner walls of two opposite sides of said flat paper body;

a separate bottom paper placed on an upper surface of said bottom; and a hollow space formed between said upper holed flat portion and said separate bottom paper, said separate bottom paper being wetted with water to extinguish burning or smoking cigarette butts.

* * * * *